US011566499B2

(12) United States Patent
Hoelscher et al.

(10) Patent No.: US 11,566,499 B2
(45) Date of Patent: Jan. 31, 2023

(54) PRESSURE-ACTUATED SAFETY FOR WELL PERFORATING

(71) Applicant: Halliburton Energy Services, Inc., Houston, TX (US)

(72) Inventors: Christopher C. Hoelscher, Arlington, TX (US); Jason Karl Cook, Crowley, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 40 days.

(21) Appl. No.: 17/346,981

(22) Filed: Jun. 14, 2021

(65) Prior Publication Data

US 2022/0397020 A1 Dec. 15, 2022

(51) Int. Cl.

| | |
|---|---|
| ***E21B 43/1185*** | (2006.01) |
| ***F42D 5/00*** | (2006.01) |
| ***E21B 43/117*** | (2006.01) |
| ***E21B 43/119*** | (2006.01) |

(52) U.S. Cl.
CPC ..... *E21B 43/11852* (2013.01); *E21B 43/117* (2013.01); *E21B 43/119* (2013.01); *F42D 5/00* (2013.01)

(58) Field of Classification Search
CPC ..... E21B 43/117; E21B 43/11852; E21B 43/11855; E21B 43/119; F42D 5/00
See application file for complete search history.

(56) References Cited

U.S. PATENT DOCUMENTS 4,544,034 A * 10/1985 George ..... E21B 43/1185 175/4.54
4,629,001 A * 12/1986 Miller ..... E21B 43/11852 175/4.52
4,678,044 A * 7/1987 Luke ..... E21B 43/11852 175/4.54
4,969,525 A 11/1990 George et al.
5,277,262 A 1/1994 Huber et al.
(Continued)

FOREIGN PATENT DOCUMENTS

CN 1158382 9/1997
WO 2019-027950 2/2019

OTHER PUBLICATIONS

International Search Report and Written Opinion for Application No. PCT/US2021/038713, dated Mar. 3, 2022.

*Primary Examiner* — Jennifer H Gay
(74) *Attorney, Agent, or Firm* — John W. Wustenberg; C. Tumey Law Group, PLLC

(57) ABSTRACT

A safety mechanism and method for downhole perforating are disclosed. In one example, a mechanical firing head includes a firing pin carried on a pin carrier within a housing. The firing pin is movable from a retracted position to a firing position for striking an explosive initiator. A retention member retains the firing pin in the retracted position with the safety member in the armed position. A safety member is biased to a safety position that additionally blocks movement of the firing pin. The safety member is moveable to an armed position that unblocks movement of the firing pin in response to an arming pressure supplied to the housing bore. The retention member releases the firing pin in response to a firing pressure supplied to the housing in excess of the firing pressure.

20 Claims, 6 Drawing Sheets

(56) References Cited

U.S. PATENT DOCUMENTS

| | | | | |
|---|---|---|---|---|
| 6,722,424 | B2 * | 4/2004 | Broad | E21B 43/11852 166/332.4 |
| 7,487,833 | B2 | 2/2009 | Grigar et al. | |
| 10,822,931 | B2 * | 11/2020 | Coffey | E21B 43/11852 |
| 10,865,626 | B2 * | 12/2020 | Preiss | E21B 23/006 |
| 11,174,713 | B2 * | 11/2021 | Brady | E21B 43/11852 |
| 11,193,358 | B2 * | 12/2021 | Preiss | E21B 43/1185 |
| 11,346,192 | B2 * | 5/2022 | Hoelscher | E21B 43/11852 |
| 11,408,258 | B2 * | 8/2022 | Preiss | E21B 43/11852 |
| 2003/0062153 | A1 * | 4/2003 | Broad | E21B 43/11852 175/2 |
| 2007/0107893 | A1 | 5/2007 | Drummond et al. | |
| 2015/0129199 | A1 | 5/2015 | Hoelscher et al. | |
| 2016/0215596 | A1 | 7/2016 | Cook et al. | |
| 2016/0237793 | A1 | 8/2016 | Albers et al. | |
| 2017/0145798 | A1 | 5/2017 | Robey et al. | |
| 2017/0175500 | A1 | 6/2017 | Robey et al. | |
| 2017/0191354 | A1 | 7/2017 | Acker et al. | |
| 2018/0038209 | A1 * | 2/2018 | Coffey | E21B 43/11852 |
| 2018/0195372 | A1 | 7/2018 | Robey et al. | |
| 2018/0209251 | A1 | 7/2018 | Robey et al. | |
| 2019/0162058 | A1 * | 5/2019 | Preiss | E21B 43/11857 |
| 2019/0234189 | A1 * | 8/2019 | Preiss | E21B 43/11852 |
| 2019/0271214 | A1 | 9/2019 | Robey et al. | |
| 2020/0088013 | A1 | 3/2020 | Grove et al. | |
| 2020/0149376 | A9 * | 5/2020 | Coffey | E21B 43/11852 |
| 2020/0182025 | A1 * | 6/2020 | Brady | E21B 43/11855 |
| 2020/0208485 | A1 | 7/2020 | Hoelscher et al. | |
| 2020/0284125 | A1 | 9/2020 | Robey et al. | |
| 2020/0386085 | A1 | 12/2020 | Badii et al. | |
| 2021/0079767 | A1 | 3/2021 | Box et al. | |
| 2021/0079769 | A1 * | 3/2021 | Preiss | E21B 23/006 |
| 2021/0102433 | A1 | 4/2021 | Robey et al. | |
| 2021/0340845 | A1 * | 11/2021 | Hoelscher | E21B 43/11852 |
| 2022/0034207 | A1 * | 2/2022 | Brady | E21B 43/11852 |

* cited by examiner

PRESSURE-ACTUATED SAFETY FOR WELL PERFORATING

BACKGROUND

Wellbores are drilled into the earth for extracting resources from earthen formations. Hydrocarbon wells, in particular, may be drilled into hydrocarbon bearing formations to extract hydrocarbon fluids such as oil and gas for use as fuel, lubricants, chemical production, and other purposes. After a wellbore has been drilled, the wellbore or portions thereof may be reinforced with a metal tubular casing. The casing is set in place by circulating cement to the annulus between the casing and the formation. After casing has been set in the wellbore, the casing and surrounding formation in the vicinity of a production zone of the formation may be perforated to allow hydrocarbon fluids to enter the well.

To perforate the well, one or more perforating guns may be run into the well on a conveyance, such as tubing or wireline. The perforation guns include explosive, shaped charges that may be selectively fired to perforate the casing and formation. The shaped charges typically include a housing, a quantity of high explosive and a liner. Perforations are formed by detonating the high explosive, which causes the liner to form a jet of particles and high pressure gas that is ejected from the shaped charge at very high velocity. The jet is able to penetrate the casing and the formation proximate to the wellbore.

Tubing conveyed perforating (TCP) systems are often used, in which one or more perforating guns are deployed on tubing, such as drillpipe or coiled tubing. TCP systems have the advantage of being able to perforate long or widely-spaced intervals simultaneously in a single trip. TCP systems conventionally use a mechanical firing head. Typically, a set of shear pins are used in a TCP firing head to avoid premature detonation. However, there have been cases where the shear pins have failed unexpectedly, such as due to a water-hammer effect. Other systems have been developed utilizing electrical sensors and complex mechanisms that increase costs and reduce reliability in downhole environments.

BRIEF DESCRIPTION OF THE DRAWINGS

These drawings illustrate certain aspects of some of the embodiments of the present disclosure and should not be used to limit or define the method.

DETAILED DESCRIPTION

A well perforating system includes a tubing conveyed firing head with a safety mechanism to avoid premature firing of a detonation train. The firing head includes a firing pin poised within a housing to strike an explosive initiator. Striking the explosive initiator with the firing pin may set off the detonation train to fire one or more perforating guns or other ballistic (explosive) elements connected thereto. The firing pin is initially constrained by a retention member, such as one or more shear members coupling a pin carrier to the housing. A pressure-activated safety mechanism additionally blocks movement of the firing pin, to lessen the risk of the retention member failing and prematurely firing the detonation train. The safety mechanism remains engaged at least until a prescribed arming pressure has been supplied. After the safety mechanism is disengaged, the retention member still retains the firing pin until a firing sequence is initiated involving an applied force (e.g., a dropped weight or applied fluid pressure) to release the retention member and propel the pin carrier. The safety mechanism thus provides redundant constraints to reduce or eliminate the risk of premature detonation, such as due to water-hammer effect or accidental drops.

The safety mechanism may use hydrostatic pressure to at least partially supply the arming pressure to facilitate releasing the safety mechanism as the firing head approaches a target depth at which the well is to be perforated. In some examples, the arming pressure is set equal to or below the hydrostatic pressure at the target depth, so the firing head is automatically armed in response to reaching the target depth. In other examples, the arming pressure is set so that it is equal to or at least slightly greater than the expected hydrostatic pressure at well depth, so that additional pressure must be affirmatively supplied to disengage the safety after the tool has reached the target depth, plus an additional firing pressure to fire the detonation train. Desirably, the safety mechanism is reversible, and automatically re-engages if the pressure were to drop back below the arming pressure prior to firing the detonation train.

Figure 1:
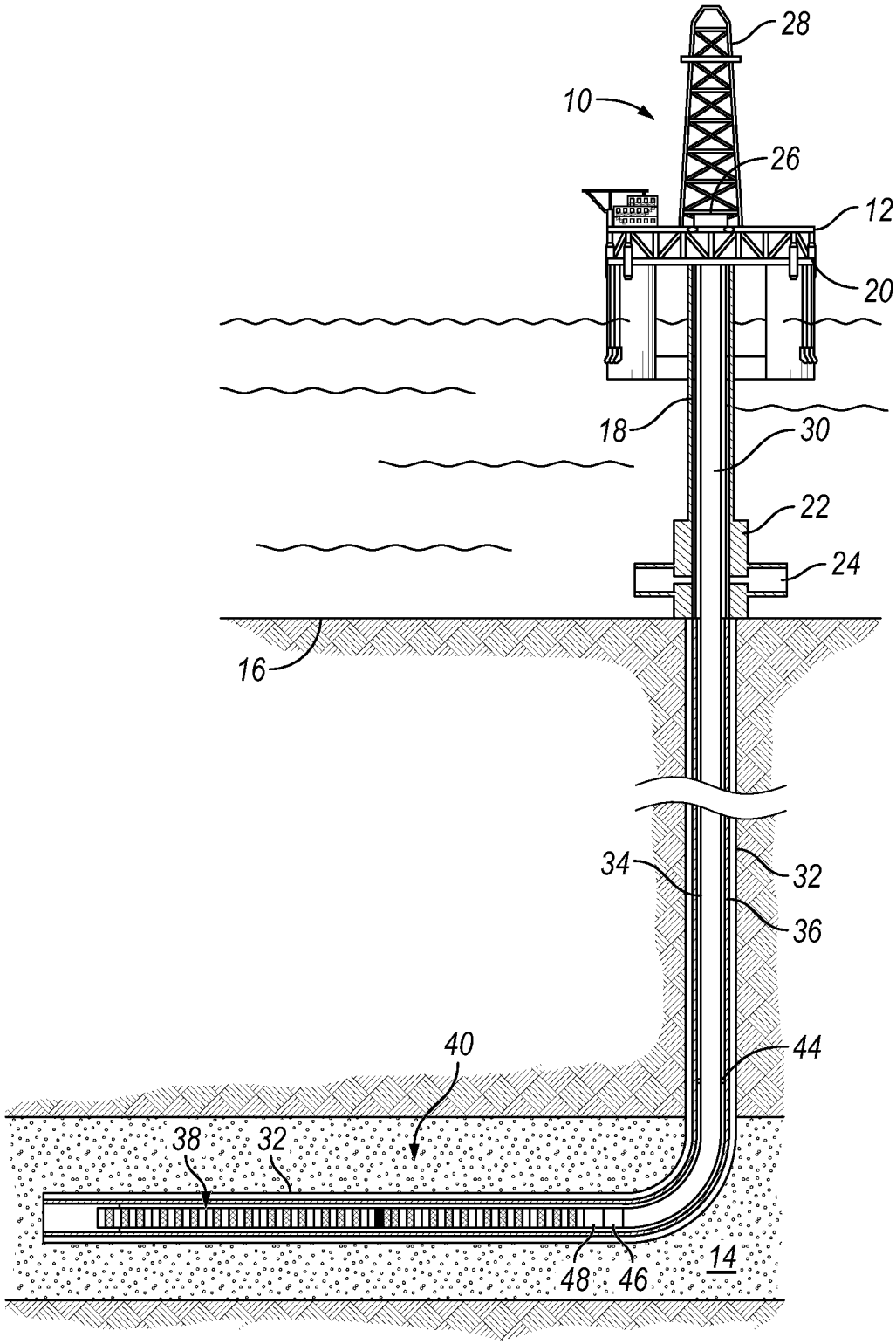
FIG. 1 is an elevation view of a wellsite in which a perforating system and method according to this disclosure may be implemented.

FIG. 1 is an elevation view of a wellsite 10 as an example environment in which a well perforating system and method according to this disclosure may be implemented. The wellsite 10 is depicted by way of example as an offshore wellsite. However, those of ordinary skill in the art will appreciate that aspects of this disclosure are also well suited to use with other types of wellsites, including land-based oil and gas drilling and production. The offshore wellsite 10 includes a semi-submersible platform 12 centered over a submerged oil and gas formation 14 located below sea floor 16. A subsea conduit 18 extends from a deck 20 of the semi-submersible platform 12 to a wellhead installation 22 that includes subsea blow-out preventers 24. The platform 12 has a hoisting apparatus 26 and a derrick 28 for raising and lowering pipe strings such as work sting 30. The work string 30 may be used as a conveyance for a perforating system in this case. A perforating system according to this disclosure may be configured for use on any of a variety of conveyances, such as a wireline, slick line, tubing string, or coiled tubing. However, the embodiments below are particularly well suited for tubing-conveyed perforation (e.g. using a tubing string or coiled tubing).

A wellbore 32 extends through the various earth strata of the formation 14. The wellbore 32 may be drilled with any given wellbore path using directional drilling techniques as necessary, resulting in any number of wellbore sections that deviate from vertical. In this example, the wellbore 32 has a generally vertical portion from the sea floor 16 and a horizontal section below that. It should be noted, however, by those skilled in the art that the principles of the present disclosure are equally well-suited for use in other well configurations including, but not limited to, inclined wells, wells with restrictions, non-deviated wells and the like.

A wellbore casing 34 is cemented within a wellbore 32 by cement 36, which lines and reinforces the wellbore 32. The tubular work string 30 may be used to convey a perforating system generally indicated at 40, including a plurality of perforating guns 38. To perforate the casing 34, the work string 30 may be lowered through casing 34 until the perforating guns 38 are positioned as desired relative to the formation 14. As further described below, the hydrostatic pressure in the wellbore 32 about the perforating guns 38 may be used to release a safety mechanism, to arm a mechanical firing head in the perforating system 40. Thereafter, an additional pressure may be supplied to release a firing pin to set off a detonation train, thus firing the shaped charges within the string of perforating guns 38. Upon detonation, the liners of the shaped charges form jets that create a spaced series of perforations extending outwardly through the casing 34, cement 36 and into the formation 14. These perforations allow fluid communication between the formation 14 and the wellbore 32.

Examples of perforating system components are discussed below, including various configurations of a safety mechanism, and related methods. In any given embodiment, the firing pin is an element that directly, forcibly contacts an explosive initiator. The pin carrier is a moveable element that the firing pin rides on and whose motion is propelled in response to an applied force to bring the firing pin into the direct, forcible contact with the explosive initiator. The applied force may include, for example, a weight dropped above the pin carrier or a fluid pressure applied to the pin carrier.

In one example, the pin carrier may be initially retained above the explosive initiator by a retention member (e.g., shear pin, dogs, or balls) and struck by dropping a weight, such as a drop bar, to release the pin carrier (e.g., by shearing the shear pin or disengaging the dogs or balls). In another example, the pin carrier may comprise a piston that is retained by a retention member and released in response to dropping a weight. In yet another example, the pin carrier may comprise a piston retained above the explosive initiator by a retention member and released by applying pressure to the piston. In still another example, a ball, dart, or other sealing device may be dropped to close a port so that fluid pressure applied to a piston drives a hammer into engagement with the pin carrier. In any given embodiment, the firing pin may be separately formed and coupled to the pin carrier or integrally formed with the pin carrier. A safety mechanism is included with any of these embodiments to block this movement of the firing pin, whereby a safety member must first be released before the firing head may be fired. Various specific example configurations are provided below.

Figure 2:
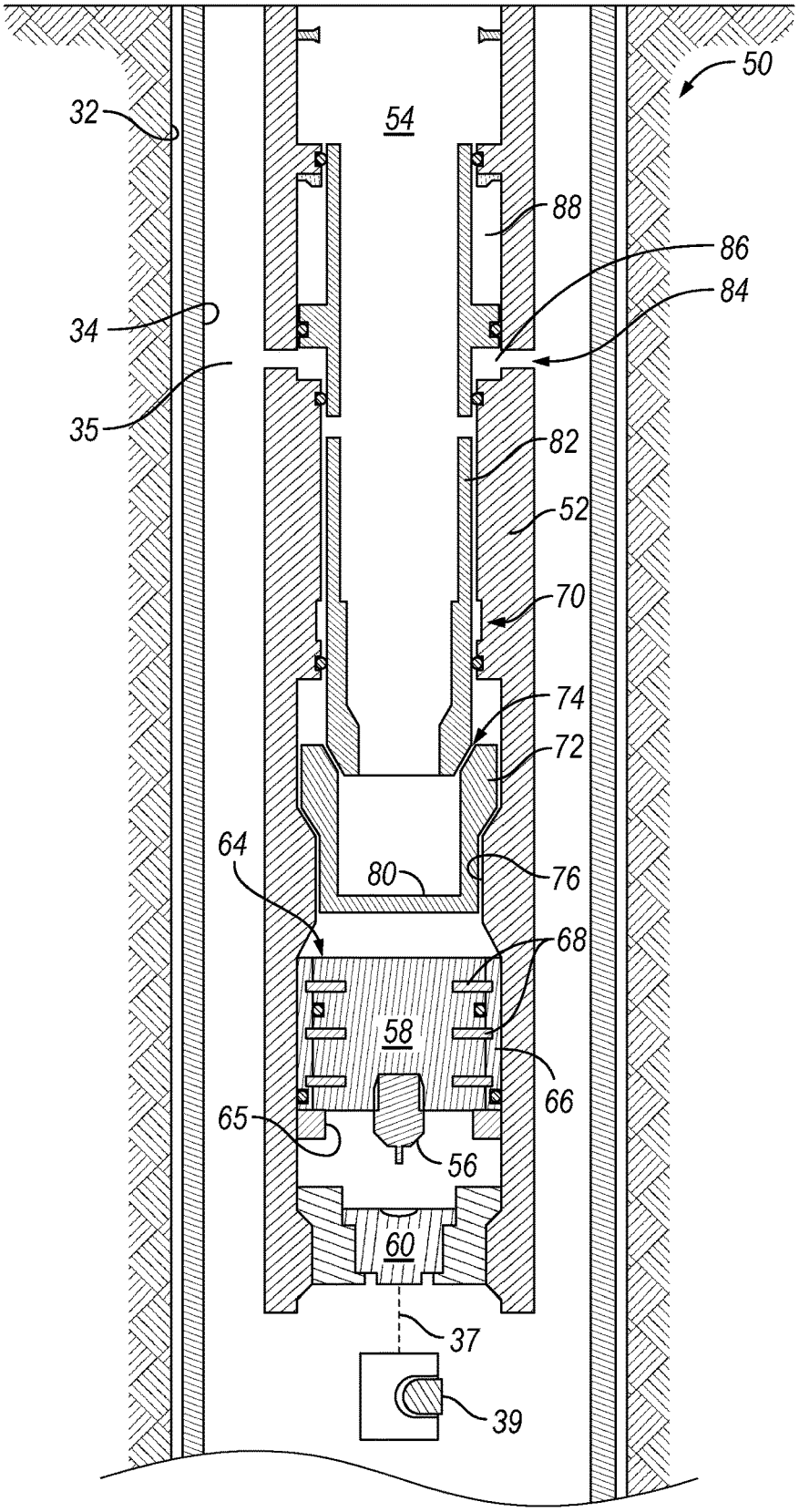
FIG. 2 is a side view of a mechanical firing head disposed in a wellbore with a firing pin retained in a retracted position and a safety mechanism blocking movement of the firing pin.

FIG. 2 is a side view of a mechanical firing head 50 being tripped into the wellbore 32 to perforate a casing 34. The firing head 50 includes a generally tubular housing 52 defining a housing bore 54. The housing 52 may be comprised of a single tubular component defining the housing bore 54 or of multiple tubular sections interconnected to collectively define the housing bore 54. The housing bore 54 generally refers to and includes the interior cavity of the housing 52, regardless of how formed, e.g., whether by boring, or by machining, stamping, forging, welding, molding, combination thereof, and/or other suitable manufacturing steps. The housing bore 54 may be subdivided into more than one, pressure-isolated or physically separated interior portions, including but not limited to chambers separated by sealing members. The housing bore 54 may thus be used to contain, control, and/or convey fluid and fluid pressure within the housing 52. The housing bore 54 may also provide interior space for moveable components of the firing head. An annulus 35 is defined between wellbore 34 (or specifically the casing 34 where present) and the housing 50. The mechanical firing head 50 and its components are not drawn to scale, and certain features may be conceptually illustrated, exaggerated, or simplified for ease of discussion.

The firing head 50 includes a firing pin 56 carried on a pin carrier 58. A hammer 80 is poised above the pin carrier 58 for engaging the pin carrier 58 when the firing head 50 is subsequently to be fired to initiate perforation. The pin carrier 58 is axially moveable within the housing bore 54 to move the firing pin 56 between a retracted position, as shown in FIG. 2, to a firing position. In the retracted position, the firing pin 56 is spaced above an explosive initiator 60 and is poised for striking the explosive initiator 60 when moved to the firing position. When moved to a striking position through application of an arming pressure followed by a firing pressure, as described below, the firing pin 56 will strike the explosive initiator 60 to fire a detonation train. The detonation train may include a detonating cord 37 and shaped charges 39 both schematically indicated in FIG. 2.

The firing pin 56 is initially retained in the retracted position via a retention member 64 engaging the pin carrier 58. The retention member 64 in this example comprise a shear block 66 secured to the housing 52 by a stop 65 and a plurality of shear members 68 coupling the pin carrier 58 to the shear block 66 and thereby to the housing 52. However, the retention member in another embodiment may comprise any other element that initially retains the pin carrier 58 with the firing pin 56 in the retracted position.

With the pin carrier and included firing pin 56 retained in the retracted position, a safety mechanism 70 is engaged to additionally block actuation of the pin carrier 58 by the hammer 80 that would otherwise move the firing pin to the firing position. A safety mechanism generally according to this disclosure may comprise any of a variety of mechanisms to block actuation of the pin carrier, including but not limited to one or more wedges or ramped surfaces, dogs, collets, balls, and so forth. The safety mechanism 70 in this example includes a slide actuator 82 moveably disposed in the housing bore 54 and a safety member 72 that is radially moveable in response to axial movement of the slide actuator 82. More particularly, a wedge member in this example includes a pair of ramped surfaces 74 defined between the slide actuator 82 and the safety member 72, which urges the safety member 72 radially outwardly in response to downward axial force applied by the slide actuator 82. The wedge member could alternatively be accomplished with a single ramped surface that engages a non-ramped surface that rides along the ramped surface. The slide actuator 82 is shown in a safety position that holds the safety member 72 radially outwardly via the ramped surfaces 74 into engagement with a shoulder 76 on the housing 52, such that the hammer 80 is blocked from engaging the pin carrier 58.

The slide actuator 82 is optionally biased to the safety position shown in FIG. 2 so that its default position or state is to block movement of the firing pin 56. However, the slide actuator 82 is moveable upwardly in response to fluid pressure in the annulus 35 via a housing port 84, to supply the annulus fluid pressure to a piston chamber 86. As the firing head 50 is lowered into the wellbore 34, the hydrostatic pressure in the annulus 35 increases in relation to the depth. As the pressure supplied to the housing port 84 increases, the upward force on the slide actuator 82 may overcome any biasing force, and the slide actuator 82 will move upwardly.

A certain minimum pressure, referred to as the arming pressure, must be supplied to the housing 52 in order for the safety mechanism 70 to release the hammer 80 to engage the pin carrier 58. The arming pressure may be at least partially supplied by the hydrostatic pressure. In one configuration, the arming pressure is set at or slightly below the expected hydrostatic pressure at the well depth to be perforated, so that the firing head 50 is armed by the time the firing head 50 reaches the target depth. Alternatively, the arming pressure may be set at least slightly above the expected hydrostatic pressure so that the pressure to the annulus 35 must be affirmatively increased in order to reach the arming pressure to arm the firing head 50.

Figure 3:
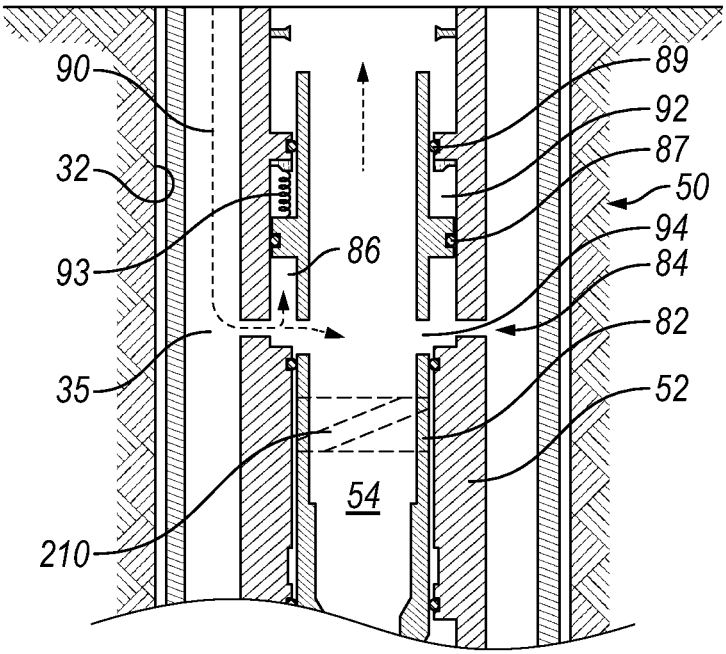
FIG. 3 is a side view of an upper portion of the firing head with the slide actuator raised in response to a fluid pressure supplied to the housing port.

FIG. 3 is a side view of an upper portion of the firing head 50 with the slide actuator 82 raised in response to a fluid pressure supplied to the housing port 84. The fluid pressure is supplied via a fluid 90 in the annulus 35. The fluid 90 may be any well fluid in the annulus 35, such as an engineered wellbore fluid ("mud"), which may be formulated to have a selected density, viscosity, and other properties. The fluid 90 in the annulus 35 has a hydrostatic pressure component as a function of the fluid density and depth. Thus, at least the hydrostatic pressure may be applied via the housing port 84, which may be enough to raise the slide actuator 82. The upward pressure is applied via the fluid 90 in the piston chamber 86, acting between a pair of upper and lower sealing members (e.g., O-rings) 87. The fluid pressure in the annulus 35 may be increased above hydrostatic pressure by applying a positive pressure from the surface of the wellsite.

In the embodiment of FIG. 2, the slide actuator 82 moves axially (and, more specifically, upwardly in this example) in response to the fluid pressure, and no rotational movement of the slide actuator 82 may be necessary. It should be noted, however, that pressure supplied to the housing may move the slide actuator 82 both axially and rotationally, such as via an optional, wide-pitch threaded member generally indicated at 210. Such rotational movement may be useful with alternative configurations of a safety member that relies at least in part on rotational movement responsive to pressure to actuate a safety mechanism, such as discussed in relation to FIGS. 7 and 8 below. Other movements are possible in other configurations within the scope of this disclosure.

Certain forces may resist upward movement of the slide actuator 82, such as a weight of the slide actuator 82 and friction resistance. An additional biasing force may also be provided. For example, an adjacent chamber 92 defined between the slide actuator 82 and the housing 52 between the upper seal 87 and another seal 89 may be pressurized with a gas or fluid. The adjacent chamber 92 may be at atmospheric pressure when at a surface level of the wellsite, or may be pre-pressurized above atmospheric pressure to help bias the slide actuator 82 downward to the position of FIG. 2. An additional biasing force may be provided by an optional spring element schematically indicated at 93, disposed between the slide actuator 82 and the housing 52. The biasing force may be selected so that the safety mechanism (see FIG. 2) remains engaged as it is lowered from the surface of the wellsite to at least the target depth at which the firing head 50 will be used to perforate the well. The biasing force may also be tuned so that the safety mechanism remains engaged to block the movement of the firing pin at the target depth until pressure is increased at least slightly to release the firing pin.

At its position shown in FIG. 3, the slide actuator 82 has been sufficiently raised that an interior port 94, which was previously sealed from the housing port 84 in FIG. 2, is now in fluid communication with the housing port 84 in FIG. 3. Thus, the fluid 90 is communicated from the annulus 35 into the bore 54 of the housing 52 and into a bore of the slide actuator 82. With the safety mechanism released, fluid pressure from the annulus 35 may now be increased to the firing pressure when it is desired to fire the firing head 50.

Figure 4:
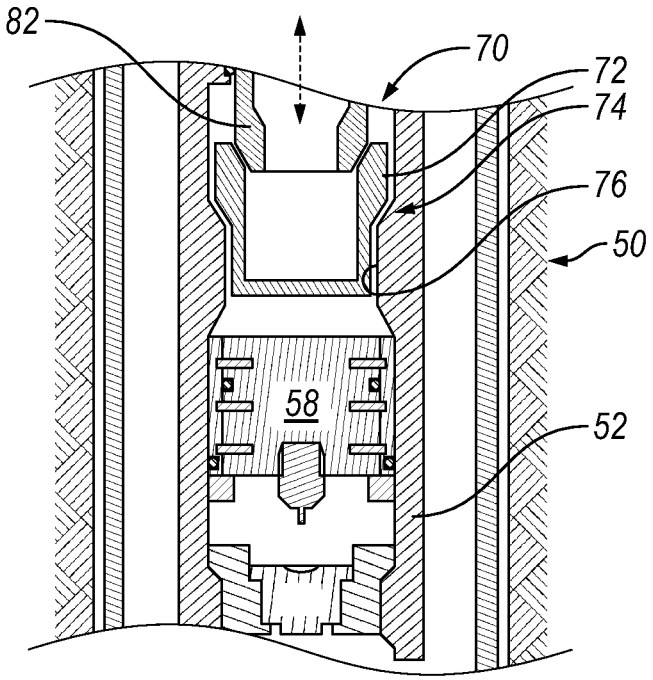
FIG. 4 is a side view of the lower portion of the firing head with the slide actuator partially raised to start releasing the hammer.

FIG. 4 is a side view of the lower portion of the firing head 50 with the slide actuator 82 partially raised to start releasing the hammer 80. The safety member 72 may be moveably coupled to the hammer 80 in a way allowing some radial movement of the safety member 72. For example, the safety member 72 may comprise dogs, a collet, a flexible coupling between the safety member 72 and the hammer 80, or other feature, wherein radial movement is used to axially secure and alternately release the hammer 80. With the slide actuator partially raised, the safety member 72 has moved radially inwardly with relative movement between the ramped surfaces 74 of the wedge member, but enough interference remains between the safety member 72 and the shoulder 76 to retain the hammer 80. Thus, the hammer 80 has not yet been fully released and is still spaced above (not contacting) the pin carrier 58.

The safety mechanism 70 may be reversible in that it may be re-engaged prior to detonation. For example, from the partially-raised position of the slide actuator 82 in FIG. 4, the ramped surfaces 74 may remain in contact as shown. If a pressure drop were to occur in the annulus 35, such as if the system were tripped out of the hole before firing, the hydrostatic pressure would drop and the slide actuator 82 would be biased back downwardly by any of the various mechanisms discussed above. This would urge the safety member 72 radially outwardly once again into full engagement with the shoulder 76 like in FIG. 2. In some configurations, the geometry and dimensional parameters may be selected so the safety mechanism 72 may be reversible at any time before firing the firing head 50, even after a full arming pressure has been applied.

Figure 5:
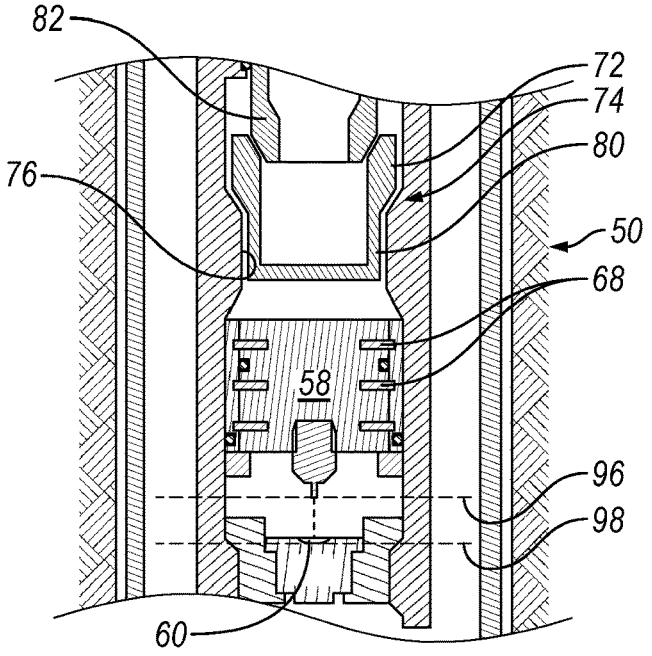
FIG. 5 is a side view of the lower portion of the firing head with the slide actuator further raised to release the hammer.

FIG. 5 is a side view of the lower portion of the firing head 50 with the slide actuator 82 further raised to release the hammer 80. The safety member 72 has radially cleared the shoulder 76 so the hammer 80 can move axially downward past the shoulder 76. The hammer 80 now engages the pin carrier 58, but not with enough force initially to shear the shear members 68 to fire the detonation train. Rather, with the hammer 80 engaging the pin carrier 58, a "firing pressure" may be applied to the hammer 80 via the annulus through the housing port 84 and interior port 94 (see FIG. 3), so the shear members 68 fail. Alternatively, the firing pressure may be delivered thru tubing pressure which is independent of arming pressure delivered through the annulus. This will release the pin carrier 58 with enough force that the firing pin 56 will move from the retracted position indicated at 96 to the striking position indicated at 98 to strike the explosive initiator 60. When forcibly moved to the striking position 98, the firing pin 56 sets off the detonation train. The firing pressure is typically in excess of the arming pressure so that the arming pressure used to release the hammer 80 does not automatically cause firing the detonation train.

Figure 6:
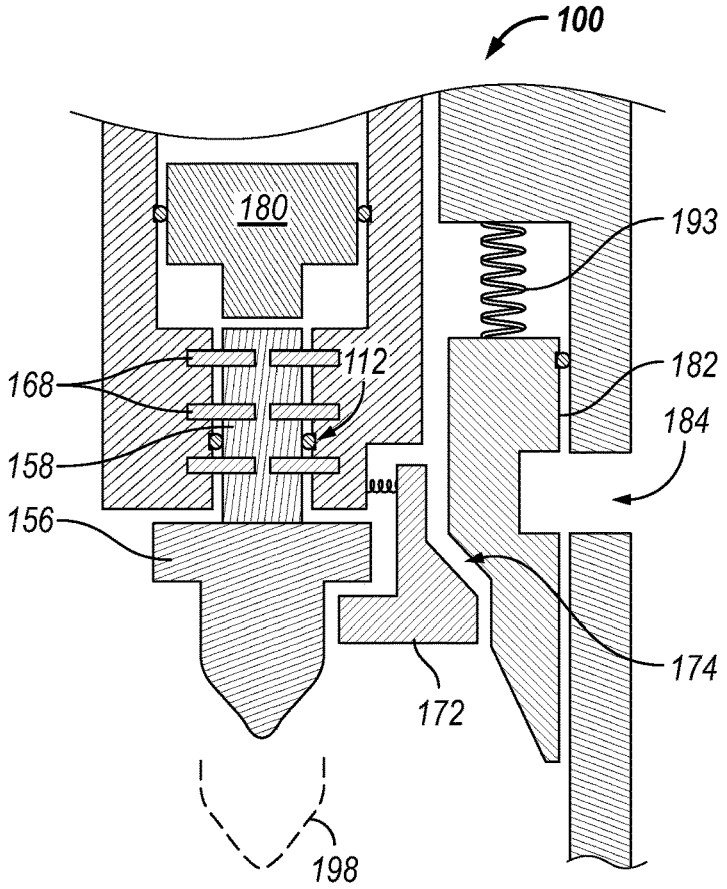
FIG. 6 is a side view of an alternate embodiment of a safety mechanism that directly blocks the firing pin when engaged.

FIG. 6 is a side view of an alternate embodiment of a safety mechanism 100 that directly blocks a firing pin 156 of a mechanical firing head. The firing pin 156 is carried on a pin carrier 158 and movable from the retracted position where it is shown to a firing position 198 for striking an explosive initiator. A safety member 172 is shown biased to a safety position that blocks movement of the firing pin 156. In this example, the safety member 172 directly physically contacts the firing pin 156, interfering with its movement, although it may be alternatively configured to directly physically block some other feature above the firing pin 156 such as the pin carrier 158.

The safety member 172 is moveable radially outwardly to an armed position that unblocks movement of the firing pin 156 in response to an arming pressure supplied to the housing bore. The arming pressure may be supplied through a housing port 184, to raise a slide actuator 182 by pressurizing a piston chamber 186 against a biasing force supplied, for example, by a biasing member 193 (e.g., spring or another, opposing pressurized piston chamber). An arming pressure is supplied to urge the slide actuator 182 upward against this biasing force, so that cooperating ramped surfaces 174 allow the safety member 172 to be moved radially outwardly. Once the safety member 172 has moved sufficiently radially outwardly to an armed position, it radially clears the firing pin 156, so that the safety member 172 no longer blocks movement of the firing pin 156.

A retention member 168 retains the firing pin 156 in the retracted position with the safety member 172 in the armed position. The retention member again comprises shear members 168, but may comprise any other element designed to retain the firing pin carrier 158. An additional pressure may be supplied to the housing from above the pin carrier 158 to shear the shear members 168 and release the firing pin 156 in response to the firing pressure. The pin carrier 158 may be designed to respond directly to such fluid pressure, such as with a sealed piston/cylinder arrangement indicated at 112. Alternatively, a pressure-actuatable member (hammer) 180 may be disposed above the pin carrier 158 to transfer the force imparted by the firing pressure from the hammer 180 to the pin carrier 158 to shear the shear members 168 and fire the detonation train.

Figure 7:
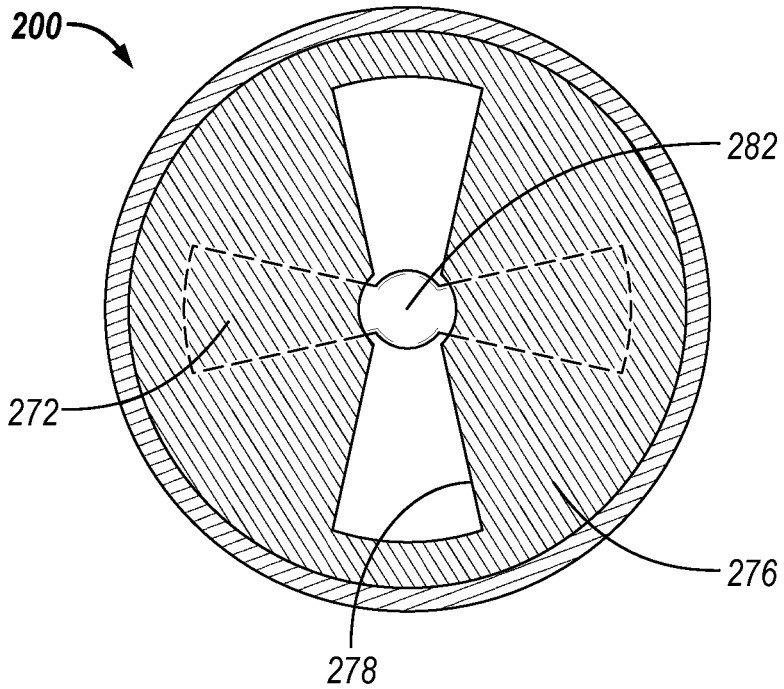
FIG. 7 is a bottom view of an alternate embodiment of a safety mechanism having a rotational safety member in a safety position.
Figure 8:
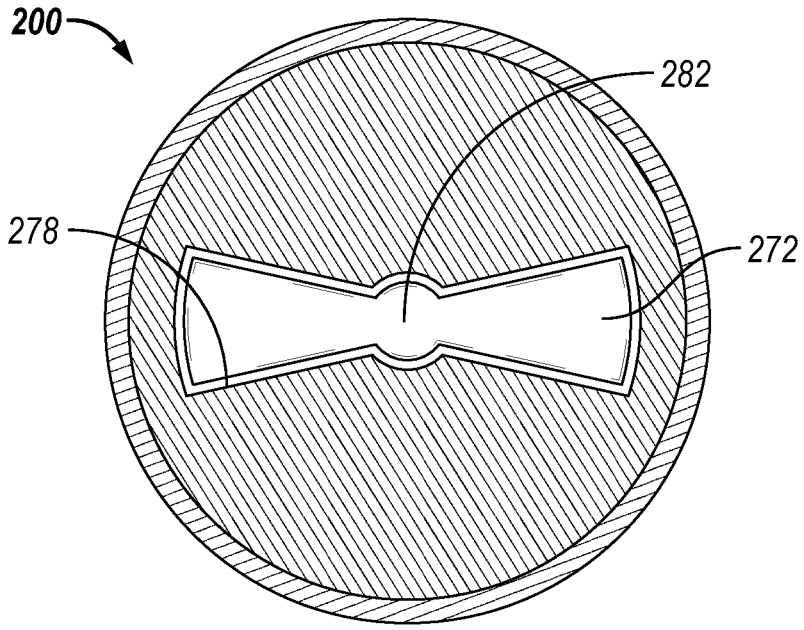
FIG. 8 is a bottom view of the safety mechanism of FIG. 7, wherein the rotational safety member has been rotated to an armed position in response to axial displacement of a piston.

FIGS. 7 and 8 illustrate an example of a rotational safety mechanism that relies at least in part on rotational movement to selectively arm and disarm a firing head. Rotational motion could be provided by an axial, cylindrical piston driving a steep pitch thread, by a wiper valve arrangement, or by numerous other mechanisms. In one example, a slide actuator could serve as the piston operably connected with the wide-pitch threaded member 210 optionally indicated in FIG. 2. The rotational safety mechanism could be an interrupted thread, a "butterfly" shaped void and lug as illustrated below, or other such mechanism.

FIG. 7 is a bottom view of a safety mechanism 200 wherein a rotational safety member 272 is in a safety position. The safety member 272 coupled to a cylindrical piston 282 whose pressure-responsive axial reciprocation drives rotation of the rotational safety member 272 between the safety position of FIG. 7 and the armed position of FIG. 8. A stopper plate (e.g., lug) 276 has a cutout 278 that generally matches the shape of the rotational safety member 272, which in this example is a "butterfly" shape. The safety member 272 is rotationally misaligned with the cutout 278 and therefore cannot pass axially through the cutout 278 (out of the page).

FIG. 8 is a bottom view of the safety mechanism 200 of FIG. 7, wherein the rotational safety member 272 has been rotated to an armed position in response to axial reciprocation of the piston 282. For example, the rotational safety member 272 may be urged from the safety position of FIG. 7 to the armed position of FIG. 8 by application of an arming pressure to the piston 282. In the armed position, the safety member 272 is now rotationally aligned with the cutout 278 and therefore can pass axially through the cutout 278 (out of the page). Thus, an additional pressure (firing pressure) may be applied from above to advance the piston 282 axially, which may be used to shear one or more shear members of a pin carrier so that a firing pin may strike an explosive initiator. The rotational safety mechanism 200 of FIGS. 7 and 8 thus conceptually illustrate how a safety member may be responsive to other types of motion other than pure axial reciprocation. However, one of ordinary skill in the art will appreciate that the illustration of FIGS. 7 and 8 is conceptual and that other embodiments may visually depart from what is shown here by way of example.

This pressure activated safety mechanism may be applied to any number of firing head designs/firing mechanisms where the movement of a firing pin can be arrested to prevent unintentional detonation. This applies regardless of if the force applied to release the pin carrier is delivered by tubing pressure, annulus pressure, flowing pressure (such as coiled tubing), a dropped bar or similar, or an electrically activated firing head with a moveable firing pin. Additionally, this applies regardless of conveyance method. Tubing (jointed pipe) or coiled tubing are the primary descriptions, however this invention may be applied to firing mechanisms delivered by wireline (slickline, braided, etc.), or by downhole tractor, or by pumpdown or gravity, or by other means.

It will be appreciated in view of the above discussion that the disclosure encompasses not only the physical structures of the disclosed example systems but also methods of safely perforating a well. Such method(s) may be performed with any of the disclosed example systems or other systems that apply the teachings of this disclosure.

Figure 9:
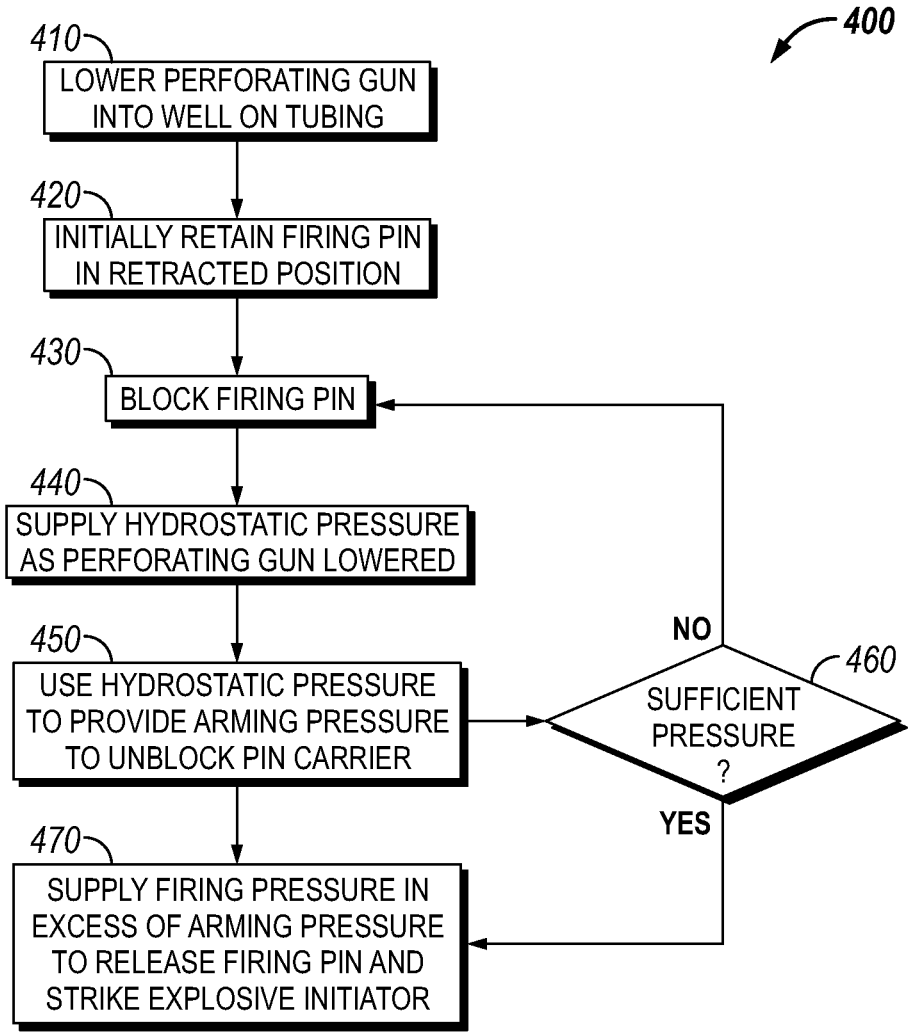
FIG. 9 is a flowchart generally outlining a method of safely perforating a well according to one or more example embodiments.

FIG. 9 is a flowchart 400 generally outlining a method of safely perforating a well according to one or more example embodiments. In step 410, a perforating gun is lowered into a well on tubing, such as coiled tubing or a tubular string comprising multiple tubing segments connected end to end. The perforating gun may include a detonation train, which may include a detonating cord coupled to one or more shaped charges and an explosive initiator coupled to the detonating cord. The detonation cord may be coupled to one or more shaped charges disposed on one or more charge holders in one or more perforating guns.

Step 420 entails initially retaining a firing pin in a retracted position within a housing, such as the housing of a mechanical firing head. With an appropriate sequence of steps, the firing pin is moveable to strike the explosive initiator to fire the one or more perforating guns. The firing pin may be initially retained per step 420 using a retention member such as one or more shear members coupled to the housing.

In step 430, movement of the firing pin is additionally blocked, i.e., in addition to the retention by the retention member. Blocking the firing pin provides a redundant safety measure that increases safety relative to using shear members or other retention members alone. The firing pin may be directly blocked, such as with direct mechanical contact and/or interference between the firing pin and a moveable safety member. Movement of the firing pin may alternatively be indirectly blocked, such as by blocking some other element (e.g., a hammer) from engaging the firing pin or pin carrier.

In step 440, a hydrostatic pressure is supplied to the housing (housing is exposed to increasing hydrostatic pressure) as the perforating gun is lowered in the well. Step 450 uses the hydrostatic pressure, at least in part, to provide an arming pressure to unblock movement of the pin. Thus, the hydrostatic pressure supplied to the housing may provide at least some of the pressure that will be used to unblock the firing pin (to arm the firing head) and/or to release the retention member to fire the detonation train.

Decisional step 460 is to detect sufficient pressure at least prior to firing the firing head. Sufficient pressure may be a threshold pressure determined relative to the hydrostatic pressure at a target depth. If pressure is insufficient, such as if there is a drop in pressure, the method involves returning to step 430, to re-block the firing pin. This step provides additional safety to re-engage the safety mechanism to block the firing pin. This may be useful, for example, in the event of an unexpected pressure loss to the well, or if an operator decides to trip the perforating system back out of the wellbore (thus reducing hydrostatic pressure) prior to perforating the well.

Finally, step 470 is to supply a force, which may be in response to a firing signal (example: pressure in excess of the arming pressure) to propel the pin carrier to strike the explosive initiator with the firing pin. Step 470 can only be performed after the safety mechanism has been released (step 450) to unblock the firing pin. For safety reasons, it still requires the affirmative additional step in 470 of supplying the firing signal even after movement of the firing pin has been unblocked.

Accordingly, the present disclosure may provide safety mechanism and methods incorporated into a perforating system and method. The systems may include but are not limited to any of the various features disclosed herein, and the methods may be performed on the disclosed examples systems or alternate configurations of those systems within the scope of this disclosure. These alternatives include but are not limited to one or more of the following statements.

Statement 1. A firing head for a perforating system, comprising: a housing defining a housing bore; a firing pin carried on a pin carrier disposed within the housing bore and movable from a retracted position to a firing position for striking an explosive initiator with the firing pin; a safety member biased to a safety position that blocks movement of the firing pin, the safety member moveable to an armed position that unblocks movement of the firing pin in response to an arming pressure supplied to the housing bore; and a retention member that retains the firing pin in the retracted position with the safety member in the armed position and releases the firing pin in response to an applied force.

Statement 2. The firing head of Statement 1, wherein the retention member comprises one or more shear members initially coupling the pin carrier to the housing with the firing pin in the retracted position, wherein the applied force comprises a firing pressure applied to the housing bore, and wherein the shear members are configured to shear in response to the firing pressure supplied to the housing bore.

Statement 3. The firing head of Statements 1 or 2, wherein the safety member is moveable from the armed position back to the safety position in response to a reduction in pressure supplied to the housing bore.

Statement 4. The firing head of any of Statement 1-3, further comprising: a slide actuator moveably disposed in the housing bore and biased to urge the safety member to the safety position; a piston chamber defined between the slide actuator and the housing bore; and an actuation port along the housing in fluid communication with the piston chamber, such that the arming pressure when supplied to the piston chamber moves the slide actuator for the safety member to move to the armed position.

Statement 5. The firing head of Statement 4, wherein the arming pressure is set equal to or greater than a hydrostatic pressure at a depth of the well to be perforated.

Statement 6. The firing head of Statement 4 or 5, further comprising: a wedge member disposed between the slide actuator and the safety member, such that axial reciprocation of the slide actuator urges the safety member radially to and from the safety position.

Statement 7. The firing head of Statement 4 or 5, further comprising: a threaded member coupled to the slide actuator such that axial movement of the slide actuator in response to the arming pressure causes rotation of the slide actuator to move the safety member to the armed position.

Statement 8. The firing head of any of Statements 4-6, further comprising a biasing member disposed between the slide actuator and the housing, wherein the biasing member is tuned to achieve a target value of the arming pressure.

Statement 9. A perforating system for a well, comprising: a perforating gun having a charge holder for mounting one or more shaped charges and a connector for connecting to tubing to convey the perforating gun into the well; a detonation train comprising a detonating cord coupled to the one or more shaped charges and an explosive initiator coupled to the detonating cord; a firing head comprising a housing defining a housing bore, a firing pin carried on a pin carrier disposed within the housing bore and movable from a retracted position to a firing position for striking an explosive initiator, and one or more shear members initially coupling the pin carrier to the housing with the firing pin in the retracted position, wherein the shear members are configured to shear in response to a firing pressure supplied to the housing bore; and a safety mechanism comprising a safety member reversibly moveable between a safety position that blocks movement of the firing pin and an armed position that unblocks movement of the firing pin, a slide actuator moveably disposed in the housing bore, a piston chamber defined between the slide actuator and the housing bore, and an actuation port along the housing in fluid communication with the piston chamber, such that an arming pressure supplied to the piston chamber moves the slide actuator in one direction to move the safety member to the armed position, and reducing pressure to the piston chamber below the arming pressure moves the slide actuator in another direction to move the safety member back toward the safety position.

Statement 10. The perforating system of Statement 9, wherein the arming pressure is equal to or greater than a hydrostatic pressure in the well at a target perforating depth.

Statement 11. The perforating system of Statement 9 or 10, further comprising: an interior port disposed along the slide actuator; a hammer disposed in the housing and poised to strike the pin carrier; and wherein moving the slide actuator to release the safety member places the actuation port in fluid communication with the interior port, so that the firing pressure if supplied from the wellbore to the actuation port is applied to the pin carrier to shear the shear members.

Statement 12. A method of safely perforating a well, comprising: lowering a perforating gun into the well on tubing, with a detonating cord coupled to one or more shaped charges and an explosive initiator coupled to the detonating cord; initially retaining a firing pin in a retracted position within a housing; additionally blocking movement of the firing pin; supplying a hydrostatic pressure to the housing as the perforating gun is lowered in the well; using the hydrostatic pressure, at least in part, to provide an arming pressure to unblock movement of the pin; and supplying a firing pressure in excess of the arming pressure to release the firing pin such that the firing pin strikes the explosive initiator.

Statement 13. The method of Statement 12, wherein retaining the firing pin in the retracted position comprises securing a pin carrier with one or more shear members, and wherein releasing the firing pin comprises using the firing pressure to shear the shear members.

Statement 14. The method of Statement 12 or 13, further comprising re-blocking the firing pin in response to a reduction in the hydrostatic pressure.

Statement 15. The method of any of Statement 12-14, wherein provide an arming pressure to unblock movement of the firing pin comprises supplying the arming pressure to a piston chamber defined between the housing and a slide actuator in the housing bore to move the slide actuator, and wherein supplying a firing pressure in excess of the arming pressure to release the firing pin comprises using the movement of the slide actuator to move a safety member to unblock the firing pin.

Statement 16. The method of Statement 15, wherein blocking the firing pin comprises urging the slide actuator in a first direction to radially urge a safety member to a safety position blocking the firing pin, and unblocking the firing pin comprises urging the slide actuator in a second direction to urge the safety mechanism radially to an armed position.

Statement 17. The method of Statement 15 or 16, wherein blocking the firing pin comprises rotating the slide actuator in a first direction and unblocking the firing pin comprises rotating the slide actuator in another direction.

Statement 18. The method of any of Statement 15-17, further comprising a biasing member disposed between the slide actuator and the housing, wherein the biasing member is tuned to achieve a target value of the arming pressure.

Statement 19. The method of Statement 12, further comprising supplying the firing pressure to the piston chamber after unblocking the firing pin; using the firing pressure to release the firing pin; and striking the explosive initiator with the firing pin after unblocking the firing pin and releasing the firing pin.

Statement 20. The method of Statement 12, further comprising setting the arming pressure equal to or greater than a hydrostatic pressure at a depth of the well to be perforated.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. One skilled in the art will appreciate that this pressure activated safety mechanism can be applied to a variety of firing heads regardless of if the firing "command" is delivered by hydraulic/fluid pressure means, electrical means, or by simple mechanical means (such as a "drop-bar" firing head). It is also clear that directions of upwards, downwards, radially inwards or outwards, clockwise/counterclockwise, etc. could be reversed or altered based on the design of the rest of the mechanism. Also the location of various components or features relative to other components or features may be altered or re-ordered based on the design of the rest of the mechanism.

What is claimed is:

1. A firing head for a perforating system, comprising:

a housing defining a housing bore;

a firing pin carried on a pin carrier disposed within the housing bore and movable with the pin carrier from a retracted position to a firing position for striking an explosive initiator with the firing pin;

a safety member biased to a safety position that blocks movement of the firing pin, the safety member moveable to an armed position that unblocks movement of the firing pin in response to an arming pressure supplied to the housing bore, wherein the safety member is moveable from the armed position back to the safety position; and a retention member that retains the firing pin in the retracted position with the safety member in the armed position and releases the firing pin in response to an applied force.

2. The firing head of claim 1, wherein the retention member comprises one or more shear members initially coupling the pin carrier to the housing with the firing pin in the retracted position, wherein the applied force comprises a firing pressure applied to the housing bore, and wherein the shear members are configured to shear in response to the firing pressure supplied to the housing bore.

3. The firing head of claim 1, wherein the safety member is moveable from the armed position back to the safety position in response to a reduction in pressure supplied to the housing bore.

4. The firing head of claim 1, further comprising:

a slide actuator moveably disposed in the housing bore and biased to urge the safety member to the safety position;

a piston chamber defined between the slide actuator and the housing bore; and an actuation port along the housing in fluid communication with the piston chamber, such that the arming pressure when supplied to the piston chamber moves the slide actuator for the safety member to move to the armed position.

5. The firing head of claim 4, wherein the arming pressure is set equal to or greater than a hydrostatic pressure at a depth of the well to be perforated.

6. The firing head of claim 4, further comprising:

a wedge member disposed between the slide actuator and the safety member, such that axial reciprocation of the slide actuator urges the safety member radially to and from the safety position.

7. The firing head of claim 4, further comprising:

a threaded member coupled to the slide actuator such that axial movement of the slide actuator in response to the arming pressure causes rotation of the slide actuator to move the safety member to the armed position.

8. The firing head of claim 4, further comprising a biasing member disposed between the slide actuator and the housing, wherein the biasing member is tuned to achieve a target value of the arming pressure.

9. A perforating system for a well, comprising:

a perforating gun having a charge holder for mounting one or more shaped charges and a connector for connecting to tubing to convey the perforating gun into the well;

a detonation train comprising a detonating cord coupled to the one or more shaped charges and an explosive initiator coupled to the detonating cord;

a firing head comprising a housing defining a housing bore, a firing pin carried on a pin carrier disposed within the housing bore and movable from a retracted position to a firing position for striking an explosive initiator, and one or more shear members initially coupling the pin carrier to the housing with the firing pin in the retracted position, wherein the shear members are configured to shear in response to a firing pressure supplied to the housing bore; and a safety mechanism comprising a safety member reversibly moveable between a safety position that blocks movement of the firing pin and an armed position that unblocks movement of the firing pin, a slide actuator moveably disposed in the housing bore, a piston chamber defined between the slide actuator and the housing bore, and an actuation port along the housing in fluid communication with the piston chamber, such that an arming pressure supplied to the piston chamber moves the slide actuator in one direction to move the safety member to the armed position, and reducing pressure to the piston chamber below the arming pressure moves the slide actuator in another direction to move the safety member back toward the safety position.

10. The perforating system of claim 9, wherein the arming pressure is equal to or greater than a hydrostatic pressure in the well at a target perforating depth.

11. The perforating system of claim 9, further comprising:

an interior port disposed along the slide actuator;

a hammer disposed in the housing and poised to strike the pin carrier; and wherein moving the slide actuator to release the safety member places the actuation port in fluid communication with the interior port, so that the firing pressure when supplied from the wellbore to the actuation port is applied to the pin carrier to shear the shear members.

12. A method of safely perforating a well, comprising:

lowering a perforating gun into the well on tubing, with a detonating cord coupled to one or more shaped charges and an explosive initiator coupled to the detonating cord;

initially retaining a firing pin in a retracted position within a housing;

additionally blocking movement of the firing pin with a safety member;

supplying a hydrostatic pressure to the housing as the perforating gun is lowered in the well;

using the hydrostatic pressure, at least in part, to provide an arming pressure to reversibly move the safety member to an armed position to unblock movement of the firing pin; and supplying a firing pressure in excess of the arming pressure to release the firing pin such that the firing pin strikes the explosive initiator.

13. The method of claim 12, wherein retaining the firing pin in the retracted position comprises securing the pin carrier with one or more shear members, and wherein releasing the firing pin comprises using the firing pressure to shear the shear members.

14. The method of claim 12, further comprising reblocking the firing pin in response to a reduction in the hydrostatic pressure.

15. The method of claim 12, wherein provide an arming pressure to unblock movement of the firing pin comprises supplying the arming pressure to a piston chamber defined between the housing and a slide actuator in the housing bore to move the slide actuator, and wherein supplying a firing pressure in excess of the arming pressure to release the firing pin comprises using the movement of the slide actuator to move a safety member to unblock the firing pin.

16. The method of claim 15, wherein blocking the firing pin comprises urging the slide actuator in a first direction to radially urge a safety member to a safety position blocking the firing pin, and unblocking the firing pin comprises urging the slide actuator in a second direction to urge the safety mechanism radially to an armed position.

17. The method of claim 15, wherein blocking the firing pin comprises rotating the slide actuator in a first direction and unblocking the firing pin comprises rotating the slide actuator in another direction.

18. The method of claim 15, further comprising a biasing member disposed between the slide actuator and the housing, wherein the biasing member is tuned to achieve a target value of the arming pressure.

19. The method of claim 12, further comprising supplying the firing pressure to the piston chamber after unblocking the firing pin;

using the firing pressure to release the firing pin; and striking the explosive initiator with the firing pin after unblocking the firing pin and releasing the firing pin.

20. The method of claim 12, further comprising setting the arming pressure equal to or greater than a hydrostatic pressure at a depth of the well to be perforated.

* * * * *